United States Patent [19]

Bald et al.

[11] 4,217,979

[45] Aug. 19, 1980

[54] PRODUCTION OF BLOCKS OF ROD-SHAPED ARTICLES

[75] Inventors: Hubert Bald, Gevelsberg; Joachim Zeitel, Hagen, both of Fed. Rep. of Germany

[73] Assignee: Maschinenfabrik Alfred Schmermund GmbH & Co., Gevelsberg, Fed. Rep. of Germany

[21] Appl. No.: 934,555

[22] Filed: Aug. 17, 1978

[30] Foreign Application Priority Data

Aug. 20, 1977 [DE] Fed. Rep. of Germany ..... 2737580

[51] Int. Cl.[2] ..... B65G 47/26

[52] U.S. Cl. ..... 198/419; 198/429

[58] Field of Search ..... 198/419, 420, 422, 425, 198/426, 429, 430, 418; 53/148, 149, 150

[56] References Cited

U.S. PATENT DOCUMENTS

| | | | |
|---|---|---|---|
| 3,190,459 | 6/1965 | Kochalski et al. | 198/418 X |
| 3,448,846 | 6/1969 | Bardenhagen | 198/419 |

FOREIGN PATENT DOCUMENTS

| | | | |
|---|---|---|---|
| 635292 | 9/1936 | Fed. Rep. of Germany | 198/419 |

*Primary Examiner*—James L. Rowland

*Attorney, Agent, or Firm*—Sughrue, Rothwell, Mion, Zinn and Macpeak

[57] ABSTRACT

The production of blocks of rod-shaped articles such as cigarettes from a single row of such articles comprises forming the single row of articles into groups of articles, and each group of articles into sub-groups of articles. Each sub-group of each group of articles is disposed in a respective horizontal plane and in a stepped relationship, and then the sub-groups in each group is disposed in vertically overlying relationship to form a respective block of each group of articles. The sub-groups in each group may be disposed in vertically overlying relationship by means including a plurality of elements disposed above one another and each provided with a plurality of the apertures to receive the sub-groups. A cam member may be provided which upon rotation thereof causes the elements to dispose the sub-groups into blocks of articles. Instead of using such elements a plurality of conveyor belts each disposed in a respective horizontal plane may be employed. Each belt receives a respective one of the sub-groups of each group and the belts are displaced relative to one another to dispose the sub-groups into blocks.

6 Claims, 7 Drawing Figures

PRODUCTION OF BLOCKS OF ROD-SHAPED ARTICLES

BACKGROUND OF THE INVENTION

The present invention relates to the simultaneous production of a plurality of blocks of rod-shaped articles, especially cigarettes, from a single row of the articles.

The tobacco-processing industry has in recent times increasingly gone over to connecting cigarette-manufacturing machines and cigarette-packaging machines directly into one production line. It has proved necessary to install a buffer reservoir between these machines in order to absorb short-term disturbances in the one or other machine. It has also proved to be expedient to process the cigarettes, which leave the manufacturing machine in a single-layer ordered stream, directly out of this stream with the aid of a row former into blocks necessary for the packaging of the cigarettes. For this, there is the possibility of at first processing the cigarettes into blocks and then putting them into storage as blocks into the buffer reservoir or to put into storage the rows delivered by the row former into the reservoir and to process them into blocks after the withdrawal.

A block-forming apparatus for the first possibility is described in the DT-OS No. 1 586 102. This is an apparatus for the formation of three-layer blocks, in which at first one row of cigarettes is conveyed forward, which corresponds to the n-fold number of the lowermost layer of a block. This row is then divided up into n groups and pushed in one row into a container for the reception of n cigarette blocks. This container is thereupon lowered by the height of one cigarette layer and a row of the n-fold number of the middle layer of a block is fed forward, which is then subdivided into n groups, displaced by half a cigarette diameter and then pushed on to the lowermost layer. The uppermost layer is then produced just as is the lowermost.

Since the middle layer of a block now mostly contains a different number of cigarettes than the uppermost and lowermost layer, it is necessary for the row former to supply rows of different numbers, which is technically very difficult and exensive, just as the realization of the transverse-axial splaying motion. A serious disadvantage is that all the containers, which form the reservoir, are only suitable for cigarette blocks of a certain number of cigarettes and number of layers, and so they must be exchanged completely on restting the apparatus for producing blocks containing a different number of cigarettes.

Because of this disadvantage, the second possibility is preferred, since rows of different length can be put into storage in one and the same container. These rows must then be formed into blocks after their withdrawal from the containers.

An apparatus suitable for this purpose is described in the DT-PS No. 1 293 672. It is possible with this apparatus to form rows of cigarettes comprising a constant number of cigarettes into blocks, as many blocks being formed at once by this device as the block contains layers, which is normally three.

It is an object of the present invention to form as many blocks as possible at once, since the operating speed of modern packaging machines severely restricts the time at disposal for block formation.

It is a further object of the present invention to simultaneously form from rows containing a constant number of cigarettes, a greater number of cigarette blocks, the number of which should be independent of the number of the layers in one block.

According to one aspect of the present invention there is provided a method for the simultaneous production of a plurality of blocks of rod-shaped articles from a single row of said rod-shaped articles disposed side by side and comprising an integral multiple of the number of said rod-shaped articles to be formed into each block, the method comprising the steps of providing said single row of said rod-shaped articles, forming said single row of said rod-shaped articles into a plurality of groups of said rod-shaped articles each containing the same number of said rod-shaped articles and simultaneously with said formation of said groups disposing each group of said rod-shaped articles into a plurality of sub-groups of said rod-shaped articles by disposing each sub-group of each group of said rod-shaped articles in a respective horizontal plane and in a stepped relationship with one another in said respective sub-group, and disposing the sub-groups in each group of rod-shaped articles in vertically overlying relationship to form a respective block of each said group of said rod-shaped articles.

According to another aspect of the present invention there is provided an apparatus for the simultaneous production of a plurality of blocks of rod-shaped articles from a single row of said rod-shaped articles disposed side by side and consisting of an integral multiple of the number of said rod-shaped articles to be formed into each block, the apparatus comprising conveyor means for providing said single row of said rod-shaped articles, means for forming said single row of said rod-shaped articles into a plurality of groups of said rod-shaped articles each containing the same number of said rod-shaped articles and for simultaneously with said formation of said groups disposing each group of said rod-shaped articles into a plurality of sub-groups of said rod-shaped articles by disposing each sub-group of each group of said rod-shaped articles in a respective horizontal plane and in a stepped relationship with one another in said respective sub-group, and means for disposing the sub-groups in each group of said rod-shaped articles in vertically overlying relationship to form a respective block of each said group of rod-shaped articles.

Said means for forming may comprise a plurality of stepped receptacle means each disposable to receive a respective group of said rod-shaped articles, each stepped receptacle means comprising a plurality of horizontal levels each dispoable to receive a respective sub-group of a respective group of said rod-shaped articles and being vertically displaceable to a raised position to dispose each sub-group of a respective group of said rod-shaped articles in said respective horizontal plane and in said stepped relationship.

Said means for disposing may comprise a storage member provided with a plurality of apertures extending therethrough to receive said sub-groups of said rod-shaped articles from said stepped receptacles, each aperture being aligned with a respective sub-group of said rod-shaped articles when said stepped receptacles are at said raised position.

Said storage member may comprise a plurality of elements disposed above one another and each provided with a plurality of said apertures, said means for disposing further comprising a cam member rotatable to cause relative displacement between said elements to dispose said sub-groups of said rod-shaped articles in said blocks thereof.

One of said elements may be fixed.

Said means for forming may comprise a plurality of conveyor belts each disposed in a respective horizontal plane to receive a respective one of said sub-groups of each group of said rod-shaped articles from said stepped receptacles, said conveyor belts being displaceable relative to one another to dispose said sub-groups of said rod-shaped articles in said blocks thereof.

BRIEF DESCRIPTION OF THE DRAWINGS

An embodiment of the present invention will now be more particularly described by way of example and with reference to the accompanying drawings, in which.

DESCRIPTION OF THE PREFERRED EMBODIMENTS

Figure 1:
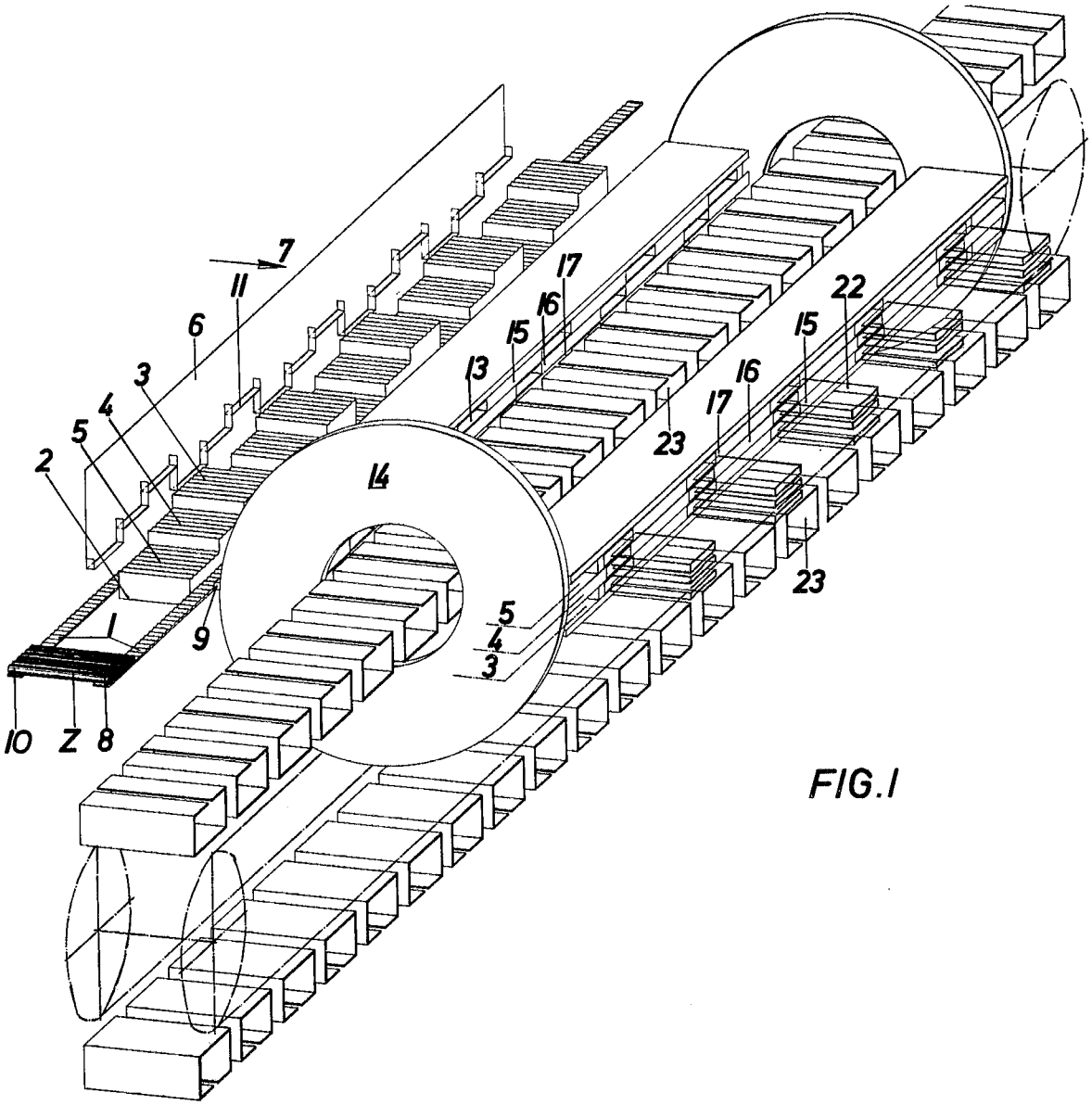
FIG. 1 shows a simplified perspective view of apparatus embodying the present invention.
Figure 3:
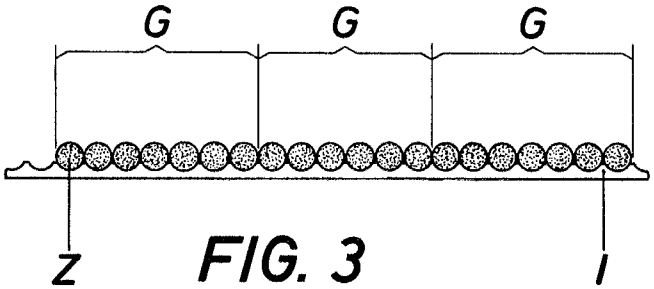

Referring now to the accompanying drawings, FIG. 1 shows how a single-layer row of cigarettes Z, which each have the same spacing from one another is conveyed forward. A conveyor belt 1 is intermittently driven by, for example, a three-wheel gear drive. Five cigarette blocks each of twenty cigarettes are formed simultaneously. One row of cigarettes thus consists of 100 cigarettes which are conveyed, during each cycle of the apparatus by the conveyor belt and then come to rest. This initial position is shown in FIG. 3.

Figure 4:
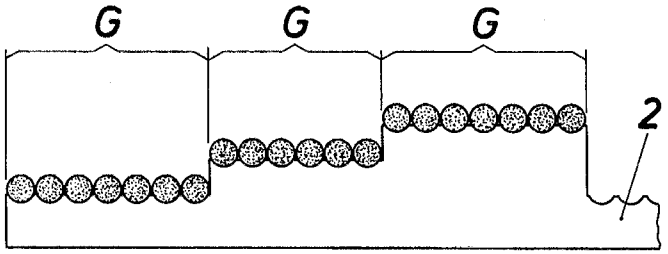
FIGS. 3 to 7 show schematically the individual phases of the block formation.

During the time the conveyor belt is at rest, the row of cigarettes Z is divided up by a lifting device 2 with steplike receptacles into five groups each comprising sub-grous G of 7–6–7 cigarettes and raised into planes 3, 4 and 5 as shown in FIG. 4.

A transfer slide 6 is then moved in the direction of the arrow 7, during which time the front of the cigarettes Z enter an insertion strip 9. Simultaneously, they are supported at their rear end 10 by stepped support strips 11 of the transfer slide 6, so that the lifting device 2 can again be lowered below the plane of the conveyor belt 1 and can feed a new row of 100 cigarettes.

Figure 2:
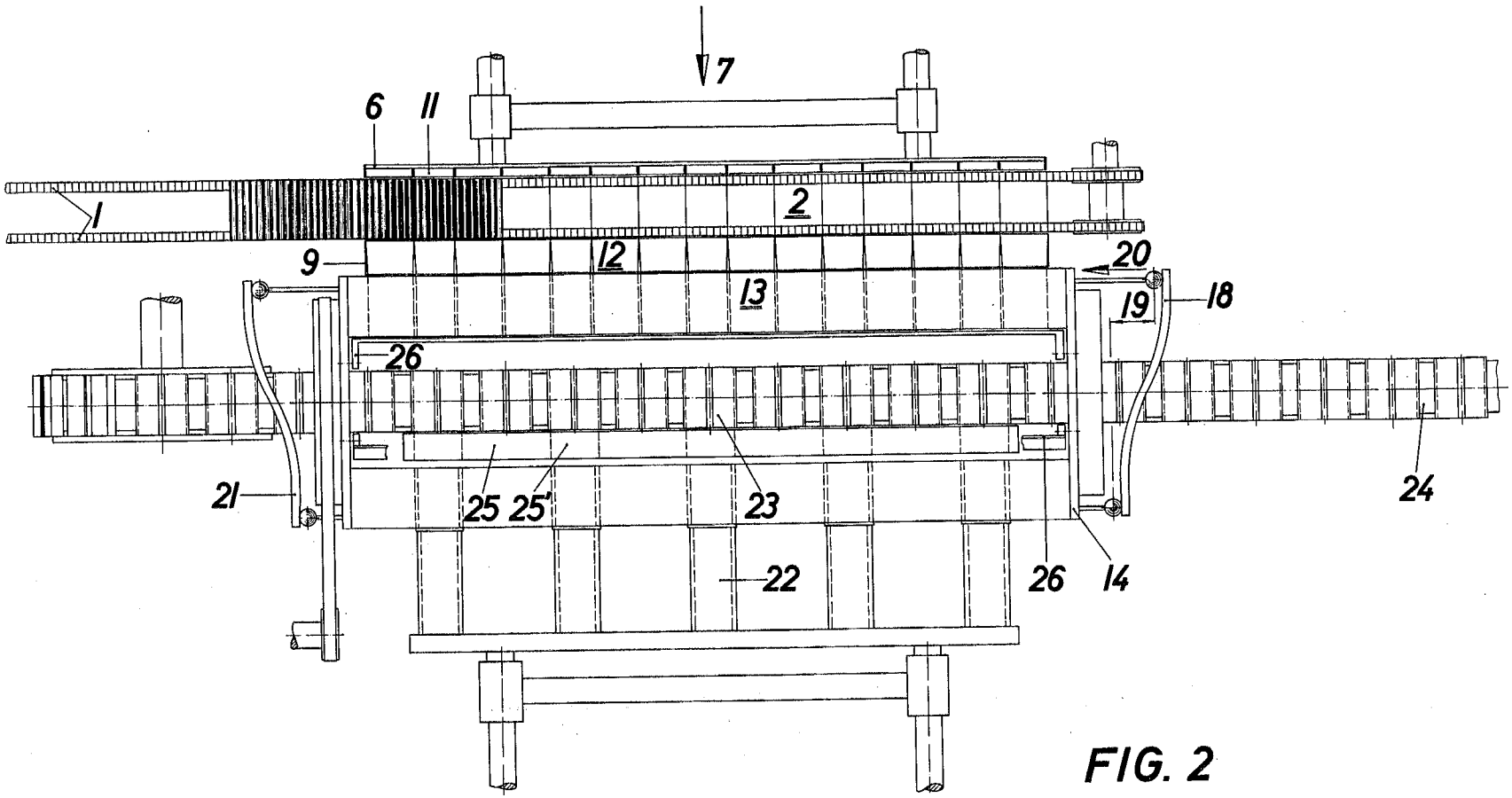
FIG. 2 shows a plan view of the apparatus.
Figure 6:
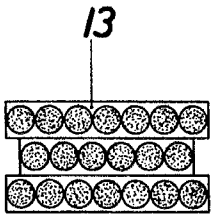
Figure 5:
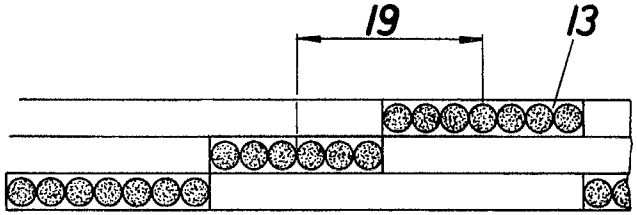

The cigarette sub-groups G are then, as FIG. 2 shows, conveyed by the transfer slide 6 through channels 12 of the insertion strip 9 into pockets 13 of a swivel revolver cam 14. This is shown in FIG. 5. The pockets 13 are displaced laterally from one another in strips 15 to 17 which are disposed above one another. The strip 15 is displaced in the plane 3 in the direction of the arrow 20 by an amount 19 through a camming action with a device 18 on pivotation of the revolver cam 14 through 180°. The strip 17 is displaced in the plane 5 in the opposite direction by the same amount through a camming action with a device 21. The strip 16 in the plane 4 is rigidly connected with the revolver cam 14. The pockets 13 of the revolver cam 14 are closed by a motionally controlled closure member 26 during the pivotal motion. The revolver cam 14 may be provided with four or more divisions, so that the pivotal motion then amounts to 90° or less. The result of the displacement is shown in FIG. 6.

Figure 7:
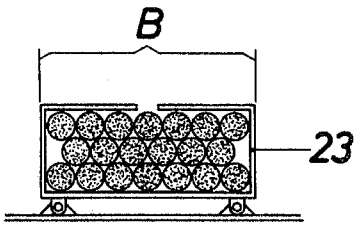

As soon as the revolver 14 has pivoted through 180°, the closure member 26 is displaced to open the pockets and the cigarette blocks B are pushed by an ejector 22 into every second cell 23 of a cell chain 24, while the individual blocks B are reduced in height during conveying through channels 25′ in a strip 25. The result is shown in FIG. 7.

The cell chain 24 is then advanced by five cells so that the remaining empty cells are filled during the next operating step.

The cigarette blocks are then removed from the cell chain and fed to the packaging machine.

The displacement transversely of the axis of the cigarettes of the sub-groups in each group may be effected other than by a revolver cam. The cigarette sub-groups may be deposited on three belts, arranged in the different plane and provided with receiving means, and then be brought above one another by appropriately different displacement transversely of the axis of the cigarettes.

We claim:

1. A method for the simultaneous production of a plurality of blocks of rod-shaped articles from a single row of said rod-shaped articles disposed side by side and comprising an integral multiple of the number of said rod-shaped articles to be formed into each block, the method comprising the steps of:

(a) providing said single row of said rod-shaped articles;

(b) forming said single row of said rod-shaped articles into a plurality of groups of said rod-shaped articles each containing the same number of said rod-shaped articles and simultaneously with said formation of said groups disposing each group of said rod-shaped articles into a plurality of sub-groups of said rod-shaped articles by disposing each sub-group of each group of said rod-shaped articles in a respective horizontal plane and in a stepped relationship with one another in said respective sub-group; and (c) disposing the sub-groups in each group of rod-shaped articles in vertically overlying relationship to form a respective block of each said group of said rod-shaped articles.

2. An apparatus for the simultaneous production of a plurality of blocks of rod-shaped articles from a single row of said rod-shaped articles disposed side by side and consisting of an integral multiple of the number of said rod-shaped articles to be formed into each block, the apparatus comprising:

(a) conveyor means for providing said single row of said rod-shaped articles;

(b) means for forming said single row of said rod-shaped articles into a plurality of groups of said rod-shaped articles each containing the same number of said rod-shaped articles and for simultaneously with said formation of said groups disposing each group of said rod-shaped articles into a plurality of sub-groups of said rod-shaped articles by disposing each sub-group of each group of said rod-shaped articles in a respective horizontal plane and in a stepped relationship with one another in said respective sub-group; and (c) means for disposing the sub-groups in each group of said rod-shaped articles in vertically overlying relationship to form a respective block of each said group of rod-shaped articles.

3. An apparatus as claimed in claim 2, wherein said means for forming comprises a plurality of stepped receptacle means each disposable to receive a respective group of said rod-shaped articles, each stepped recepticles means comprising a plurality of horizontal levels each disposable to receive a respective sub-group of a respective group of said rod-shaped articles and being vertically displaceable to a raised position to dispose each sub-group of a respective group of said rod-shaped articles in said respective horizontal plane and in said stepped relationship.

4. An apparatus as claimed in claim 3, wherein said means for disposing comprises a storage means provided with a plurality of apertures extending therethrough to receive said sub-groups of said rod-shaped articles from said stepped receptacles, each aperture being aligned with a respective sub-group of said rod-shaped articles when said stepped receptacles are at said raised position.

5. An apparatus as claimed in claim 4, wherein said storage member comprises a plurality of elements disposed above one another and each provided with a plurality of said apertures, said means for disposing further comprising a cam member rotatable to cause relative displacement between said elements to dispose said sub-groups of said rod-shaped articles in said blocks thereof.

6. An apparatus as claimed in claim 5, wherein one of said elements is fixed.

* * * * *